US005992427A

United States Patent [19]

Playe

[11] Patent Number: 5,992,427

[45] Date of Patent: Nov. 30, 1999

[54] SUPPORT FOR A TAKE-UP ELEMENT AND A PACKAGING UNIT COMPRISING THIS SUPPORT

[75] Inventor: Jacques Playe, Bondoufle, France

[73] Assignee: L'Oreal, Paris, France

[21] Appl. No.: 08/764,881

[22] Filed: Dec. 16, 1996

[30] Foreign Application Priority Data

Dec. 15, 1995 [FR] France ..... 95 14939

[51] Int. Cl.[6] ..... A45D 40/12; A45D 40/22

[52] U.S. Cl. ..... 132/317; 132/295; 206/15.3; 401/123; 401/125

[58] Field of Search ..... 206/362.3, 15.3; 132/317, 318, 313, 312, 315, 293, 294, 295; 401/125, 123

[56] References Cited

U.S. PATENT DOCUMENTS

| | | | |
|---|---|---|---|
| 1,688,042 | 10/1928 | Gaess | 132/315 |
| 4,423,811 | 1/1984 | Knapp | 206/15.3 X |
| 4,815,608 | 3/1989 | Silberberg | 132/295 |
| 5,197,623 | 3/1993 | Wang . | |
| 5,244,090 | 9/1993 | Keith | 206/15.3 X |
| 5,348,031 | 9/1994 | Cloud | 132/317 |
| 5,586,653 | 12/1996 | Taveroff | 132/295 X |

FOREIGN PATENT DOCUMENTS

| | | |
|---|---|---|
| 0 641 720 | 3/1995 | European Pat. Off. . |
| 1338551 | 8/1963 | France . |

*Primary Examiner*—Steven A. Bratlie
*Attorney, Agent, or Firm*—Young & Thompson

[57] ABSTRACT

A combination of a support and a take-up element includes a container with a partial lid and an element for taking up the product. The take-up element is contained within the support, which is rigid and arranged so as to ensure the repeated removal and repositioning of the take-up element within this rigid support and the protection of the take-up element from the exterior.

8 Claims, 1 Drawing Sheet

SUPPORT FOR A TAKE-UP ELEMENT AND A PACKAGING UNIT COMPRISING THIS SUPPORT

BACKGROUND OF THE INVENTION

The present invention relates to a support for a take-up element and to a unit for the packaging and application of a product. More precisely, it relates to a unit comprising a container optionally provided with a lid and an element for taking up the product.

This unit may be used in many fields, in particular, in the fields of cosmetics, dermatology, and pharmaceutics, and for the packaging of creams, gels, powders, or even of granulated materials. It can also be used in the field of varnishes, paints, glues and adhesives.

It is known that the packaging units for products are provided with a take-up element intended to take up and possibly to apply the product to a surface to be treated. This element is generally made of an inexpensive material, like plastics or wood, and is disposable. For practical reasons of hygiene and of convenience, many packaging units are provided with one such a take-up element in the package. Generally, this take-up element is not joined to the container or even the lid, and is for example provided in a separate sealed plastic sachet, ensuring that it is clean.

Such arrangements have several drawbacks: indeed, during the manufacture of the packaging unit, the pliability of this protective sachet makes it impossible for it to be positioned on the container or on its lid in an automated process. These protective sachets containing the take-up element are therefore introduced manually into a box containing the closed container filled with the product. Such an operation increases the time and the cost of producing these units, which nevertheless have to be produced in very large quantities. Moreover, this work is tedious for the packaging operators.

Furthermore, once opened during the first use of the take-up element, the sachet cannot be used again and the take-up element is no longer protected from the exterior (dust, sprays etc.) during the period of its use, it being possible for the use to extend over several weeks for a cosmetic product or a food product (such as mustard).

It is also known that the take-up element is placed within the lid of the container of the packaging unit and that it is protected by a tearable cover, as described in FR-A-1280021. However here too, the take-up element is no longer protected after its first use.

From EP-A-0517963 it is, moreover, also known that the take-up element is placed on a tearable cover surmounting a container, and that the cover and the take-up element are covered by a lid closing the container. But this arrangement has the same drawbacks as those described above.

There thus remains the need for a unit for the packaging and application of a product, comprising an element for taking up this product, which can be easily made on an industrial scale and be obtained in particular in a completely automated manner and which ensures the protection of this take-up element over the whole duration of its period of use.

The present invention aims to satisfy this requirement.

SUMMARY OF THE INVENTION

The invention therefore provides a new support for a take-up element comprising an applicator part and a holding part, characterized in that the take-up element is accommodated inside the support, and in that the support is rigid and arranged so as to ensure, on the one hand, the repeated removal of the take-up element from and its replacement within this support and, on the other hand, the protection from the exterior of at least the applicator part of the take-up element when at rest.

The invention also provides a new unit for the packaging and application of a product, in particular a cosmetic product, comprising i) a container containing the product, ii) an element for taking up the product, and iii) a support for the take-up element, in accordance with the invention.

Advantageously, such a packaging unit is used for cosmetic products.

The invention also provides a method for manufacturing a packaging and applicator unit in accordance with the invention, this method comprising the step of automated positioning of the support in accordance with the invention on the container or on the lid previously fixed on the container.

Advantageously, the rigid support comprises means for holding the take-up element in position, as for example a sheath of a shape conforming to that of the take-up element, delimited in particular between a bottom and a cap. This sheath may be made of one and the same piece. In particular a recess, formed at least partly in the bottom of the support and/or in the cap, may be made in a shape complementary to that of the take-up element. The sheath and, in particular the recess formed in the bottom and/or in the cap of the support, forms an element for wiping the take-up element. If the packaged product is a cosmetic product intended to be taken up by a spatula of an elongate shape, the bottom of the rigid support will have the shape of a boat intended to receive this spatula. The cap may be articulated to the bottom (or boat) by means of a hinge, and may cover a portion of the bottom so as to protect the portion of the spatula serving to take up and to apply the product.

The support and the lid of the container containing the product may be moulded together and form only a single part. The support may optionally be provided with a skirt comprising fastening means allowing the support and the container to be joined together. In this case, the support performs the function of a lid.

However, for closing the container it is preferable to provide a lid that is independent of the support.

Such a packaging and application unit has the advantage that it can be very easily manufactured on an industrial scale. Indeed, the rigidity of the support in accordance with the invention permits automation of the step of positioning it. Since the support is rigid, it can be easily gripped on an assembly line and can be positioned on the lid of the container inside the box in which the packaging unit will be supplied.

The rigid support may be made by any conventional technique used for making accessories, for example by the injection moulding of one or more materials: it may be formed of one or more parts made of the same material or of different materials. The various parts may be assembled by bonding, or catch engagement or may even be welded.

Advantageously, the material or materials constituting the support have a sufficient rigidity to permit an automated dispensing of the support. Within the meaning of the present invention, a rigid part is understood to mean a part that is not deformed under its own weight. Thus the support in accordance with the invention must not be deformed under its own weight. The materials which are particularly suitable for the invention may be any kind of plastic material, as for example, high density polyethylene, polypropylene or also polyacetal. Alternatively, the support may be made of cardboard or also of metal.

Apart from the possibility of mechanising its positioning, such a support has the advantage of ensuring the protection of the take-up element from the exterior before and during the whole duration of its use. It can also serve to lightly wipe the take-up element. Finally, this support is washable; it can be opened and thus be easily cleaned.

BRIEF DESCRIPTION OF THE DRAWINGS

The invention and its operation will become more clearly apparent with the help of the description that follows, given with reference to the attached drawings, wherein.

DESCRIPTION OF THE PREFERRED EMBODIMENTS

Figure 1:
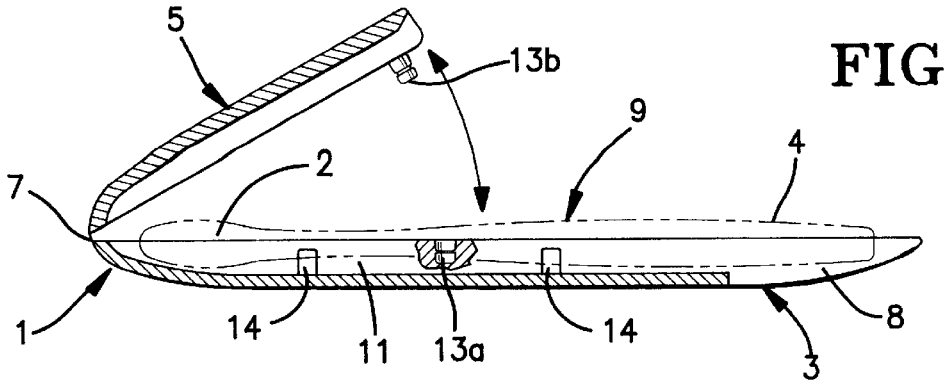
FIG. 1 is a sectional view of the rigid support of the invention, with a spatula.
Figure 2:
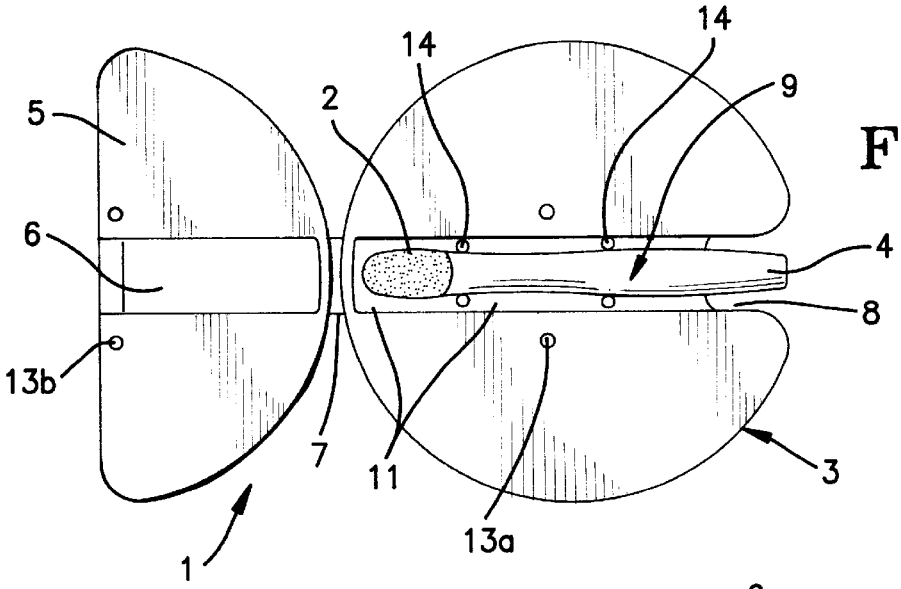
FIG. 2 is a top view of the support in accordance with the invention, when open and containing a spatula.

In the embodiment of FIGS. 1 and 2, the rigid support, bearing as a whole the reference numeral 1, comprises a boat-shaped bottom 3 and a cap 5 which are articulated round a film hinge 7. The shape of the rigid support may be adapted to the shape of the container intended to receive it. Here the support has the shape of a flattened cylinder. An element 9 for taking up the product is represented as accommodated between the bottom and the cap. This element comprises an applicator part 2 for the product and a part 4 to be held by the user. This take-up element is here represented by a spatula. The bottom and the cap have means for being fastened to one another, such as catch-engagement elements 13*a* and 13*b*. Moreover, the bottom has a complementary recess 11 matched to the shape of the spatula. Similarly, the lid has a complementary recess 6. The spatula is therefore held tightly between these two recesses as if in a sheath, this sheath being closed on the side where the applicator part of the take-up element, here the spatula, is situated. On either side of the spatula, there are situated studs 14 which ensure a better centering of the spatula within the recess 11. The cap 5 has a length substantially equal to half of that of the bottom 3. It can be opened by means of the hinge 7. The spatula is arranged in such a way that the applicator part is protected by the cap and the holding part is left uncovered. To allow the user to extract more easily the take-up element, and in particular the spatula, a cutout 8 is arranged in the bottom opposite the holding part.

Such a packaging unit keeps the spatula clean in the course of its use, and it is very easy to use: at each use; the consumer removes the spatula from the rigid support by drawing it towards her. If she wishes, she may also first open the cap of the support and subsequently withdraw the spatula. To put the spatula away after use is also very simple: it is sufficient to catch-engage the spatula in the bottom of the support before or after having opened the cap. The recesses formed in the cap and in the bottom are adjusted so as to form an element for wiping the take-up element, in particular the spatula. The user can thus use the cap for lightly wiping the spatula. She may subsequently open the cap completely for cleaning the support.

Figure 3:
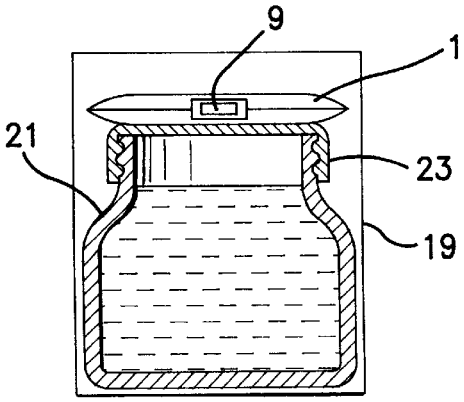
FIG. 3 is a view of a packaging unit in accordance with the invention.

In FIG. 3, there has been represented a packaging unit in accordance with the invention bearing as a whole the reference numeral 19. This unit is provided with the rigid support 1 in accordance with the invention, with a container 21 and with a lid 23. The rigid support 1 is separate from the lid 23 and is positioned on the lid. In the present case, the container and the lid have a cylindrical shape.

Figure 4:
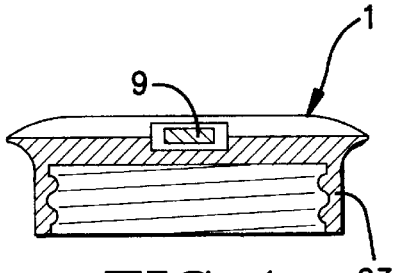
FIG. 4 is a view of the support in accordance with the invention forming the lid of a container containing a product.

In FIG. 4 there are shown the lid 23 of a container, and the support 1 in accordance with the invention, together with a spatula 9, when they are moulded together so as to form only a single part.

Figure 5:
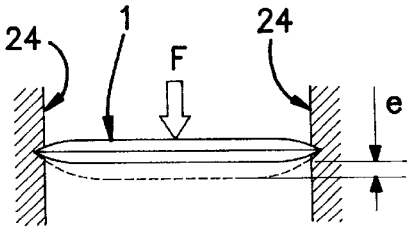
FIG. 5 illustrates a method for measuring the flexural strength of a support in accordance with the invention.

In a preferred embodiment of the invention, the elongation e of the deformation sustained by a support in accordance with the invention, having a length l equal to 58 mm and subjected to the action of a force of 10 newtons, must not exceed 7 mm. FIG. 5 illustrates the technique used by the Applicant for measuring this flexural strength of the support: the support is held in position flat and inserted between two fixed vertical walls 24; a force F of 10 newtons is applied at the centre of the support, and the elongation e of the deformation sustained by the support 1 under the action of this force is measured on the vertical axis. In these conditions, a support is obtained whose rigidity is completely adapted to the automated positioning of the support on an assembly line.

Such a packaging unit can be very easily manufactured on an industrial scale. Indeed, since the support 1 is rigid, it can be gripped in an assembly line process and positioned in an automated mode on the lid of the container containing the product to be packaged. Moreover, if the support and the lid of the container form only one unit, the positioning of the lid and support is effected in a single operation. Thus it is possible to manufacture such packaging units at very advantageous prices.

I claim:

1. A combination of a take-up element and a support therefor, said take-up element comprising an applicator and a handle attached to said applicator; and said support comprising, a rigid base, and a half cover pivotally attached to said base that covers substantially all of a first half of said base and leaves substantially all of a second half of said base exposed to an exterior when said cover is pivotally closed onto said base, said first half of said base comprising a depression in which said applicator rests, said second half of said base comprising an extension of said depression in which a part of said handle rests, said cover comprising a recess corresponding to said depression, wherein said cover protects said applicator and wherein said part of said handle is exposed, when said cover is pivotally closed onto said base.

2. The combination of claim 1, wherein said second half of said base comprises a notch in an edge thereof that corresponds to said extension of said depression, and wherein an end of said part of said handle is exposed within said notch.

3. The combination of claim 1, wherein said base has a circular periphery.

4. The combination of claim 1, wherein said cover is semicircular.

5. A combination of a take-up element and a support therefor, said take-up element comprising an applicator and a handle attached to said applicator; and said support comprising, a rigid base having a circular periphery, and a generally semicircular cover pivotally attached to said base that covers substantially all of a first half of said base and leaves substantially all of a second half of said base exposed to an exterior when said cover is pivotally closed onto said base, said first half of said base comprising a depression with a first portion in which said applicator rests and a second portion in which part of said handle rests, a second half of said base comprising an extension of said depression in which a further part of said handle rests, said cover comprising a recess corresponding to said first and second portions of said depression, wherein said cover protects said applicator and wherein said further part of said handle is exposed, when said cover is pivotally closed onto said base.

6. The combination of claim 5, wherein said second half of said base comprises a cutout in a periphery thereof that corresponds to said extension of said depression, and wherein an end of said further part of said handle is exposed within said cutout.

7. A combination of a take-up element and a support therefor, said take-up element comprising an applicator and a handle attached to said applicator; and said support comprising, a rigid base, and a cover pivotally attached to said base that covers a first portion of said base and leaves a second portion of said base exposed to an exterior when said cover is pivotally closed onto said base, said first portion of said base comprising a depression in which said applicator rests, said second portion of said base comprising an extension of said depression in which a part of said handle rests, a periphery of said second portion having a notch therein that corresponds to said extension of said depression, said cover comprising a recess corresponding to said depression, wherein said cover protects said applicator and wherein an end of said part of said handle is exposed within said notch, when said cover is pivotally closed onto said base.

8. The combination of claim 7, wherein said cover is semicircular.

* * * * *